United States Patent [19]

Thebert

[11] 4,363,600

[45] Dec. 14, 1982

[54] VARIABLE VANE MOUNTING

[75] Inventor: Glenn W. Thebert, Carmel, Ind.

[73] Assignee: General Motors Corporation, Detroit, Mich.

[21] Appl. No.: 251,070

[22] Filed: Apr. 6, 1981

[51] Int. Cl.[3] ..... F01D 9/02

[52] U.S. Cl. ..... 415/156; 415/140

[58] Field of Search ..... 415/140, 156, 160, 159

[56] References Cited

U.S. PATENT DOCUMENTS 3,542,484 11/1970 Mason ..... 415/160

*Primary Examiner*—Edward L. Roberts

*Attorney, Agent, or Firm*—Saul Schwartz

[57] ABSTRACT

An improved mounting arrangement for an adjustable stator vane of a turbomachine, the vane having a shaft portion projecting through an outer casing of the turbomachine and an annular button portion disposed against a thrust bearing on the inside of the outer casing and the improvement residing in the provision of a spring around the shaft portion which bears at one end against a thrust bearing on the outer casing and at the other end against a rigid cantilever extension of the shaft portion of the vane so that the spring imposes on the shaft portion an offset force which develops a moment counter to a moment developed on the stator vane by passage of compressed gas through the turbomachine thereby to prevent cocking of the stator vane in the outer casing and to more evenly distribute loading on the button portion of the vane.

4 Claims, 7 Drawing Figures

VARIABLE VANE MOUNTING

This invention relates to adjustable vane assemblies and more particularly to adjustable vanes operated by an actuator ring having a plurality of crank arms connected thereto and to vane shafts which are supported by journal and thrust bearings with respect to an outer case.

Variable vane systems including a ring of stator vanes, each having a drive shaft directed through an outer case and supported with respect to the outer case by journal and thrust bearings, are characterized by an increase in thrust bearing loadings as the vane is adjusted or air loads are increased. As bearing loads increase, the actuating force must increase to operate a full ring of such vanes.

A feature of the present invention is to provide an improved externally located support system for such variably adjustable vanes which produces a compensating moment on the vane to offset increases in thrust loadings thereon produced by changes in the attitude of the vane with respect to the supporting outer case.

In order to accomplish this feature of the present invention, in one working embodiment, a variably adjustable vane has a button which engages an engine case supported thrust bearing and further includes a shaft supported with respect to the outer case by a journal bearing. The shaft has an actuator arm connected to one end thereof and a spring component applies a fixed side moment to the shaft which offsets increases in thrust loading between the vane and the case produced by changes in the attitude of the vane with respect to the case. This reduces the amount of actuation force required to move an operating ring for driving a circle of the adjustable vanes.

Further features and advantages of the present invention will be apparent from the following description, reference being had to the accompanying drawings wherein preferred embodiments of the present invention are clearly shown.

Figure 1:
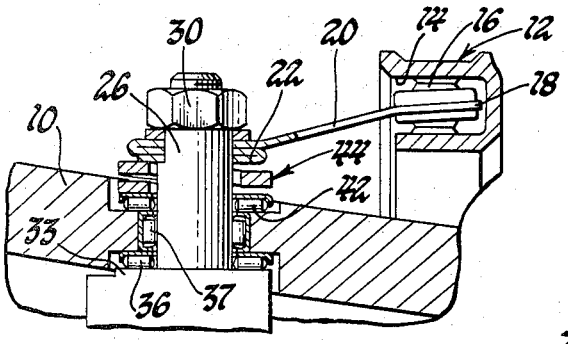
FIG. 1 is a fragmentary cross sectional view of a support and actuator system for a variably adjustable vane in a turbomachine, partly shown in elevation.

Referring now to the embodiment in FIGS. 1 through 5, an outer case 10 of a turbomachine is illustrated surrounded by an actuator ring 12 including a support channel 14 with a plurality of bearings 16 secured thereto at circumferentially spaced points thereround. Each of the bearings 16 supports an eye 18 at one end of an actuator arm 20 having the opposite end 22 thereof folded and formed to seat in interlocked relationship with a flat 24 on the side of a vane drive shaft 26. The vane drive shaft has a threaded outer end 28 that is in threaded engagement with a vane support system connector nut 30 that bears against a washer 32 interposed between the actuator arm 20 and the nut 30.

The drive shaft 26 is connected to an annular vane button portion 33 of an adjustable stator vane 34, the button portion 33 being disposed adjacent to an inboard counterbore or circular recess 35 in the outer case 10. The button portion 33 of the vane engages an inboard thrust bearing 36 disposed in the recess 35 around the shaft 26. The shaft 26 is further supported by a journal bearing 37 disposed in a shaft bore 38 through the outer case 10. In the illustrated arrangement, the case 10 is counterbored or recessed to form an outer bearing surface 40 that carries an outboard thrust bearing 42.

Figure 2:
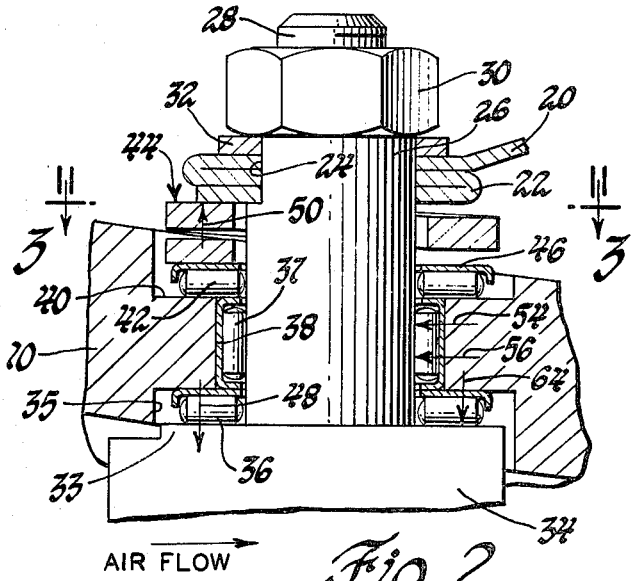
FIG. 2 is an enlarged fragmentary sectional view, partly in elevation, of the vane support components in the embodiment of FIG. 1.
Figure 3:
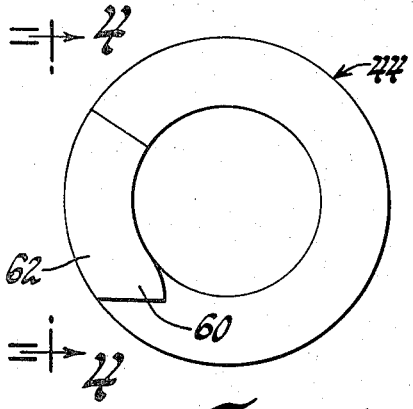
FIG. 3 is a top elevational view taken along the line 3—3 of FIG. 2, of a spring component, per se, in FIG. 2.
Figure 4:
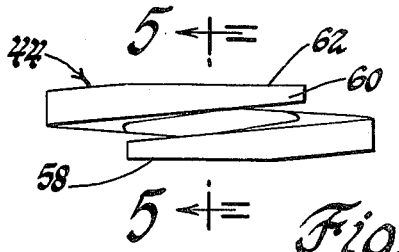
FIG. 4 is a side elevational view looking in the direction of the arrows 4—4 in FIG. 3.
Figure 5:
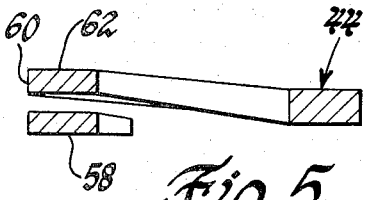
FIG. 5 is a sectional view taken along the line 5—5 of FIG. 4 looking in the direction of the arrows.

In arrangements of this type, when the engine is stopped, a support spring 44 interposed between the end 22 of the actuator arm 20 and an outer race 46 of the thrust bearing 42 biases the shaft 26 radially outwardly of the case 10 to impose on the vane 34 a button load represented by a vector 48 in FIG. 2. This load on the vane is equal to the spring-to-retainer force on the folded portion 22 represented by a vector 50 in FIG. 2. The system under air loads further includes a distributed journal bearing load which is represented by a pair of vectors 54, 56 in FIG. 2. The retainer support spring 44 will hold the button portion 33 of the vane in place against the thrust bearing 36.

In accordance with the present invention the spring 44 is similar to a one turn coil spring and includes a free end 58 that bears against the outer race 46. The spring 44 wraps upwardly from the free end 58, winding in a counterclockwise direction as viewed in FIG. 3, to an opposite free end 60. A load pad 62 on the free end 60 engages the underside of the folded end 22 of the actuator arm 20. Since one end of the spring bears on thrust bearing 42 and the other bears directly on the folded end 22, the spring rotates as a unit with the actuator arm and the shaft 26. Accordingly, the spring 44 imposes a side moment on the vane shaft at a location which does not change during adjustment of the vane.

In operation, compressed air flow impinging on the vane 34 develops a force or turning moment on the vane tending to cock the vane 34 and shaft 26 counterclockwise, FIG. 2, in the bore 38. This tendency, unless otherwise handled, results in a concentration of load on the vane 34 at a location on the right side of the shaft 26 represented, for example, by a vector 64. This load concentration is accompanied by an increase in magnitude so that the equal and opposite reaction on the thrust bearing could render it significantly more difficult to rotate the vane 34 through the actuator arm 20, a situation compounded by the fact that there are normally many such stator vanes which must be rotated simultaneously by a single adjusting mechanism such as ring 12, FIG. 1.

The placement of the spring 44 between the folded portion 22 and the thrust bearing 42, however, functions by means of the side moment applied to counter the aforedescribed tendency of the vane to cock regardless of the adjusted position of the vane. More particularly, the load pad 62 applies to the folded portion 22 a force represented by vector 50. Since the folded portion 22 is tightly clamped to the shaft 26, the folded portion to the left, FIG. 2, of the shaft represents a rigid cantilever extension of the shaft 26 upon which the force represented by vector 50 operates. The cantilever applied force develops a turning moment on the shaft 26 counter to the turning moment developed on the vane by the compressed gas flow. The effect of this counter turning moment is to reduce the magnitude of the force represented by vector 64 and, in fact, to more evenly distribute the force over the entire button portion 33 so that resistance to turning of the vane by actuator arm 20 is significantly reduced. In addition, in applications where button portion 33 bears directly on a sliding type thrust bearing instead of the needle type bearing 36, the more even force distribution effects improved sealing around shaft 26 by maintaining the button portion engaged on the thrust bearing. As noted, since the spring 44 rotates with the shaft 26, the counter moment is continuous and independent of the adjusted position of the vane.

Figure 6:
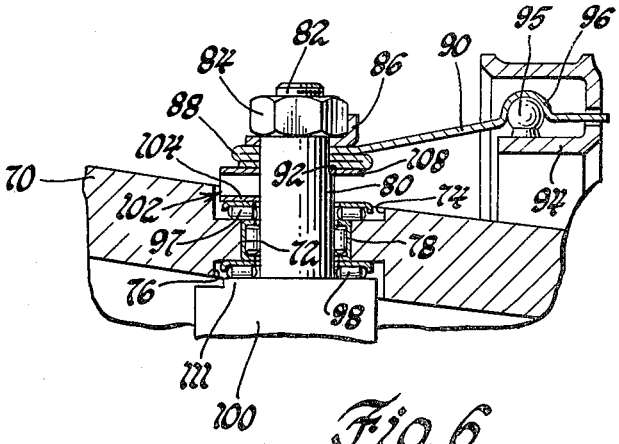
FIG. 6 is a fragmentary sectional view of another embodiment of a vane support system shown partly in elevation.
Figure 7:
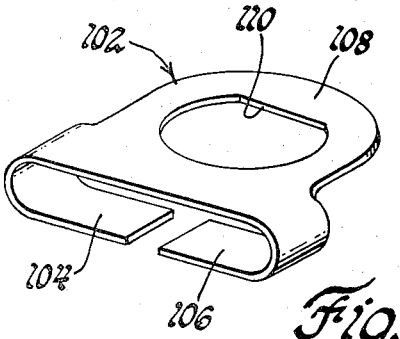
FIG. 7 is a view in perspective of a spring biasing component of the support system of FIG. 6.

In the embodiment of FIGS. 6 and 7, an engine case 70 is illustrated that has a bore 72 therethrough including an outboard thrust bearing recess 74 and an inboard thrust bearing recess 76. A journal bearing 78 in bore 72 supportingly receives a drive shaft 80. Shaft 80 has a threaded end 82 connected to a nut 84 that is indexed with respect to the shaft 80 by a retainer 86. A folded end 88 of an actuator arm 90 is nonrotatably secured to the shaft 80 at an index shoulder 92. An annular operating ring 94 surrounding the case 70 is connected to the arm 90 at a bearing 95 on the ring and a seat 96 on the arm.

A pair of thrust bearings 97, 98 disposed in recesses 74, 76, respectively, support a variably positioned vane 100 for movement with respect to the case 70, the vane being rigidly attached to the shaft 80. In this embodiment, a support bias spring 102 is interposed between the shaft 80 and the thrust bearing 97 to direct an offset, counterbalancing moment on the shaft 80 the location of which relative to the shaft will remain constant regardless of the adjusted position of the vane. The biasing force is produced by a pair of bent-over spring ends 104, 106 on the spring 102. Spring 102 includes a tab portion 108 with a keyed aperture 110 that fixedly secures the spring with respect to the shaft. As described with respect to the embodiment of FIGS. 1 through 5, the offset nature of the force applied by spring 102 functions to counter the tendency of the vane 100 to cock in the bore 72 and to more evenly distribute the loading on a button portion 111 of the vane 100. Finally, as still a further modification, it will be apparent that arm 90, if properly oriented and fabricated, can function to exert on the shaft 80 on offset force counter to the offset force produced on vane 100 by air flowing around the vane.

The embodiments of the invention in which an exclusive property or privilege is claimed are defined as follows:

1. In a turbomachine of the type having an outer casing and an adjustable stator vane assembly including a vane with a shaft portion rotatably supported on said outer casing, a bearing surface on said vane, a thrust bearing between said bearing surface and said outer casing for permitting rotation of said vane while resisting thrust loading in the direction of said shaft portion induced by fluid flow through said turbomachine, said thrust loading being offset relative to said shaft portion and producing offset loading on said thrust bearing, and actuator arm means connected to said shaft portion outboard of said outer casing for rotating said vane, the improvement comprising, spring means disposed outboard of said casing engageable on said shaft portion to effect application of spring force on said shaft portion in offset fashion thereby to develop on said shaft portion offset loading counter to said thrust force induced offset loading on said stator vane.

2. In a turbomachine of the type having an outer casing and an adjustable stator vane assembly including a vane with a shaft portion rotatably supported on said outer casing, a bearing surface on said vane, a thrust bearing between said bearing surface and said outer casing for permitting rotation of said vane while resisting thrust loading in the direction of said shaft portion induced by fluid flow through said turbomachine, said thrust loading being offset relative to said shaft portion and producing offset loading on said thrust bearing, and actuator arm means connected to said shaft portion outboard of said outer casing for rotating said vane, the improvement comprising, spring means outboard of said casing rotatable as a unit with said shaft portion, means between said spring means and said outer casing operative to transfer forces therebetween while permitting movement of said spring means with said shaft portion, and means disposed between said spring means and said shaft portion operative to effect application of spring force on said shaft portion in offset fashion and positionally fixed relative to said shaft portion to develop on said shaft portion offset loading counter to said thrust force induced offset loading on said stator vane independently of the adjusted position of said stator vane.

3. In a turbomachine of the type having an outer casing and an adjustable stator vane assembly including a vane with a shaft portion rotatably supported on said outer casing, a bearing surface on said vane, a thrust bearing between said bearing surface and said outer casing for permitting rotation of said vane while resisting thrust loading in the direction of said shaft portion induced by fluid flow through said turbomachine, said thrust loading being offset relative to said shaft portion and producing offset loading on said thrust bearing, and actuator arm means connected to said shaft portion outboard of said outer casing for rotating said vane, the improvement comprising, spring means outboard of said casing rotatable as a unit with said shaft portion, thrust bearing means disposed between said spring means and said outer casing operative to transfer spring force between said spring means and said outer casing while permitting rotation of said spring means as a unit with said shaft portion, and means defining a rigid cantilever extension from said shaft portion rotatable as a unit therewith, said spring means engaging said rigid cantilever extension to effect application of spring force on said shaft portion in offset fashion and positionally fixed relative to said shaft portion to develop on said shaft portion offset loading counter to said thrust force induced offset loading on said stator vane independently of the adjusted position of said stator vane.

4. In a turbomachine of the type having an outer casing and an adjustable stator vane assembly including a vane with a shaft portion rotatably supported on said outer casing, a bearing surface on said vane, a thrust bearing between said bearing surface and said outer casing for permitting rotation of said vane while resisting thrust loading in the direction of said shaft portion induced by fluid flow through said turbomachine, said thrust loading being offset relative to said shaft portion and producing offset loading on said thrust bearing, and actuator arm means connected to said shaft portion outboard of said outer casing for rotating said vane, the improvement comprising, a coil spring disposed outboard of said outer casing and around said shaft portion, said coil spring including a load pad offset from said shaft portion, a thrust bearing disposed between one end of said coil spring and said outer casing operative to transfer spring force therebetween while permitting rotation of said coil spring relative to said outer casing, and means defining a rigid cantilever extension on said shaft portion rotatable as a unit therewith, said coil spring at said load pad engaging said cantilever extension to effect application of spring force on said shaft portion in offset fashion and positionally fixed relative to said shaft portion to develop on said shaft portion offset loading counter to said thrust force induced offset loading on said stator vane and friction developed between said load pad and said cantilever extension being sufficient to effect unitary rotation of said shaft portion and said spring so that said counter loading occurs independently of the adjusted position of said stator vane.

* * * * *